US006233860B1

(12) United States Patent
Hazen

(10) Patent No.: US 6,233,860 B1
(45) Date of Patent: May 22, 2001

(54) SINGLE SHOT FALLING BREECH BLOCK RIFLE ACTION

(76) Inventor: Errol L. Hazen, 1101 S. Eastwood, Norfolk, NE (US) 68701

( * ) Notice: Subject to any disclaimer, the term of this patent is extended or adjusted under 35 U.S.C. 154(b) by 0 days.

(21) Appl. No.: 09/237,102

(22) Filed: Jan. 25, 1999

(51) Int. Cl.[7] ..... F41A 3/00
(52) U.S. Cl. ..... 42/23
(58) Field of Search ..... 42/23, 24, 14, 42/75.03, 69.01, 69.03; 89/24

(56) References Cited

U.S. PATENT DOCUMENTS

| | | | | |
|---|---|---|---|---|
| 94,577 | * | 9/1869 | Diaz | 42/23 |
| 239,496 | * | 3/1881 | Heeren | 42/23 |
| 511,632 | * | 12/1893 | Mason | 42/23 |
| 3,355,833 | | 12/1967 | Ruger et al. | 42/23 |
| 3,735,517 | | 5/1973 | DeHaas et al. | 42/23 |
| 3,830,000 | | 8/1974 | Browning | 42/23 |
| 4,128,956 | | 12/1978 | Foote | 42/23 |
| 4,270,294 | * | 6/1981 | Compton | 42/24 |
| 4,570,369 | | 2/1986 | Gerfen | 42/23 |
| 4,648,190 | | 3/1987 | Allen | 42/23 |
| 4,930,239 | | 6/1990 | Hunter | 42/42.01 |
| 5,659,992 | | 8/1997 | Mistretta | 42/23 |
| 5,768,815 | | 6/1998 | Casull | 42/46 |

* cited by examiner

*Primary Examiner*—Michael J. Carone
*Assistant Examiner*—Michelle Thomson
(74) *Attorney, Agent, or Firm*—Henderson & Sturm LLP

(57) ABSTRACT

A single shot falling breech block rifle action with features to allow takedown and barrel changes to accommodate different rifle caliber and chambers. The action incorporates an automatic safety which blocks the internal striker. The compact design utilizes a small number of individual components. Maximum use is made of parts which may be obtained commercially with high precision at reasonable cost. The trigger mechanism and striker share a common pivot point and reduce the requirements for external adjustments. The extractor is effective with rimmed or rimless belted cases in present use.

5 Claims, 3 Drawing Sheets

SINGLE SHOT FALLING BREECH BLOCK RIFLE ACTION

BACKGROUND OF THE INVENTION

1. Field of the Invention

The present invention relates to the field of firearms, and more particularly to a single shot falling breech block rifle.

2. Description of Related Art

The falling breech block rifle in previous variations date from the earliest breech loading designs to the present. The majority of the earlier art required rimmed cartridges for extraction and were not designed or manufactured to withstand modern high pressure loads in common use today.

The addition of modern safety features, extraction systems, and refinements for trigger adjustments are typically responsible for increasing the complexity of much of the currently produced designs and corresponding art.

Commonly, the part fitting and adjustments to prior art have been done by factory personnel or referred to reputable gunsmiths. The level of skill required to perform the services are costly due to the high costs of labor and time. At the present time, customer adjustments are not common options (or recommended) because if done incorrectly they can result in possible accidents and liability issues.

Provisions for takedown of modern designs are most often hindered due to forward mounted mainsprings and/or extractor mechanisms. This also increases difficulties encountered during stock manufacture or replacement, requiring complex fitting.

Those concerned with these and other problems recognize the need for an improved falling breech block rifle.

BRIEF SUMMARY OF THE INVENTION

Briefly stated, the present invention is intended to allow chambering and extraction of all cartridge designs in current usage. With modern materials and heat treating, this design should be suitable to handle all sporting cartridges loaded within commercial and recommended hand loading standards.

The present invention differs from modern designs most notably those by Allen, Ruger, and DeHaas, by refining the action design to use significantly fewer parts. This was accomplished by careful attention, in particular to the firing and safety mechanisms. Multiple use of common components, springs, and even common pivot locations are used when possible. This reduced the need for complex adjustment mechanisms to adjust for manufacturing tolerances, part size variations, and locations of the individual components.

In the design hereafter described, the compression spring used to provide return forces to the sear also provides spring tension to the safety and by linkage to the rest of the safety mechanisms's components. The safety is drilled to create a spring guide where the force, to the opposite force placed upon the safety, is transferred via a pin to the sear.

The design is unique in the use of common central pivot—used for both the striker and trigger. The sear requires only one additional pivot location to form the geometric relationships that will affect the functioning of the components. Trigger pull (force actually required to fire the action) and the trigger over travel are features used to critically compare the action's quality to competing designs. These are favorable within common industry standards and may be additionally modified by slight variation of springs and component dimensions.

From a manufacturing standpoint, the reduction of necessary adjustments and handwork reduces the costs of labor and increases productivity. Another significant advantage is quality improvements due to reduced variability and possible factors involving both operator training and job performance.

The invention is designed to allow for convenient takedown for the purposes of offering barrel caliber options and offers a unique takedown latch assembly. The takedown method requires removal of one screw and the loosening of the takedown latch. Change to another fitted barrel involves screwing it into the receiver, extractor change if necessary, reinstalling the screw and tightening the latch.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
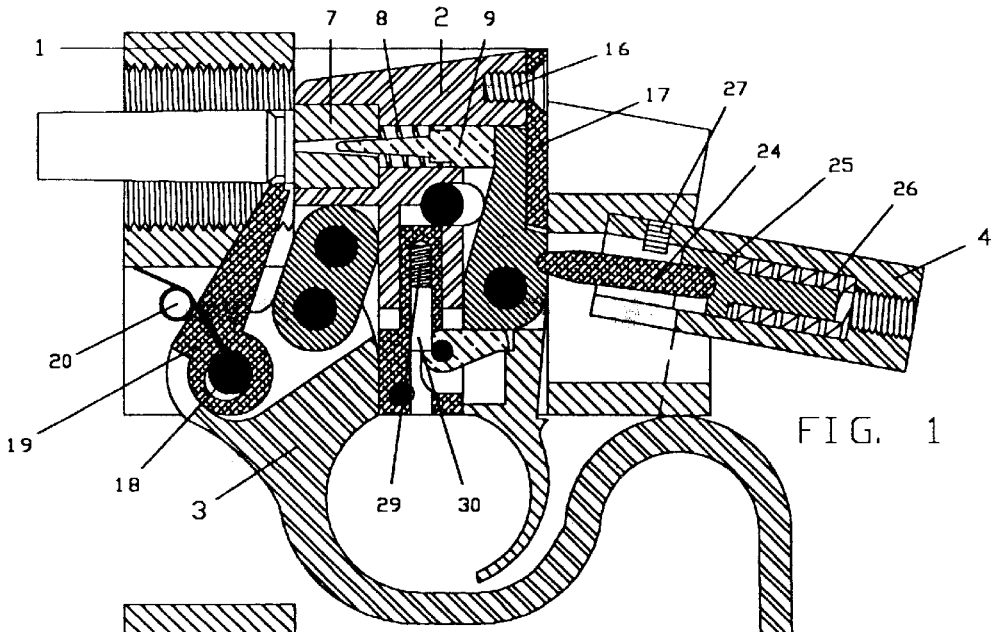
FIG. 1 is a cross sectional view through the center plane aligned with the bore axis, action is in the "FIRE" position with the action closed and ready to fire, hatched boundaries indicate regions which are sectioned at the center plane, internal voids and details, visible due to cut-away view are shown in background.

Referring now to the drawings, wherein like reference numerals designate identical or corresponding parts throughout the several views, it can be seen that the invention is comprised of a receiver 1 with a vertical rectangular slot with rounded corners to prevent the formation of stress risers. The breech block 2 is connected to the lever 3 by a connecting link 23 and two pins 21 and 22. This causes the breech block to move vertically in the receiver slot in response to rotation of the lever 3.

The barrel 60 is threaded to mate to matching threads on the receiver 1 and is locked into place by a takedown latch 6 attached within the fore stock 57. The mainspring housing 4 is attached at the rear of the receiver and is threaded to mount a rear stock in a conventional manner using a through bolt.

Figure 2:
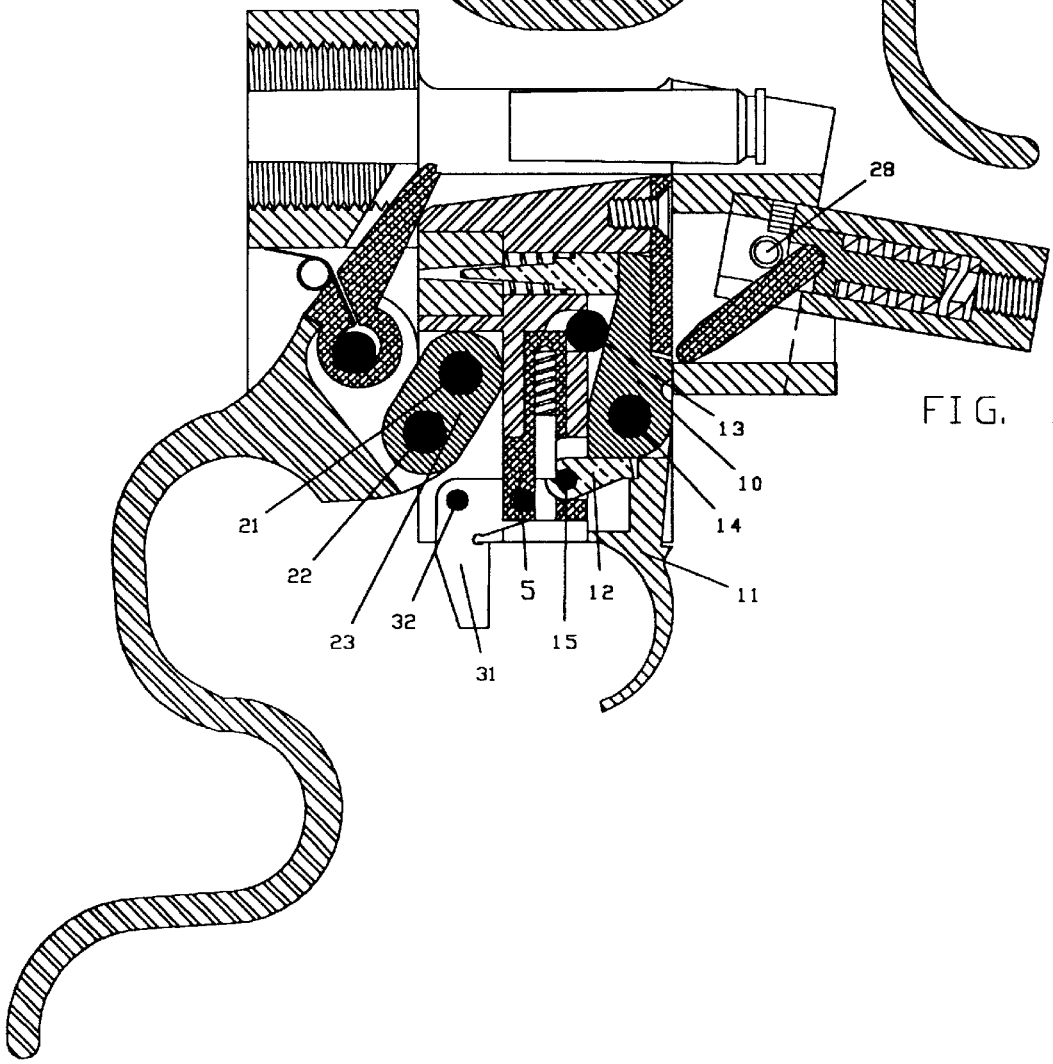
FIG. 2 is a cross section view through the center plane aligned as described above, action is fully opened with fired shell casing shown in rearward motion, all internal breech block parts are shown as they would have been repositioned, and the safety automatically returns to the "SAFE" position, mainspring is at rest in the rear of the receiver against set screw stop.
Figure 3:
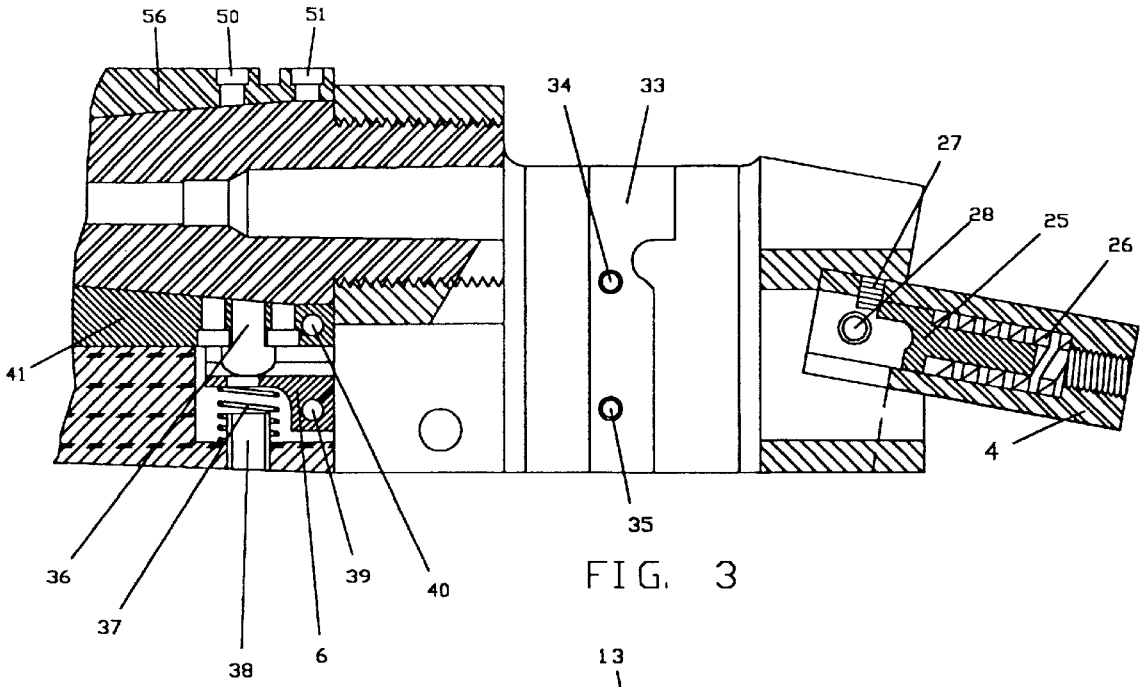
FIG. 3 is a cross section view through the center plane, breech block and lever removed from action to show cocking wedges and screws, cut away section of barrel and takedown latch mechanism.
Figure 7:
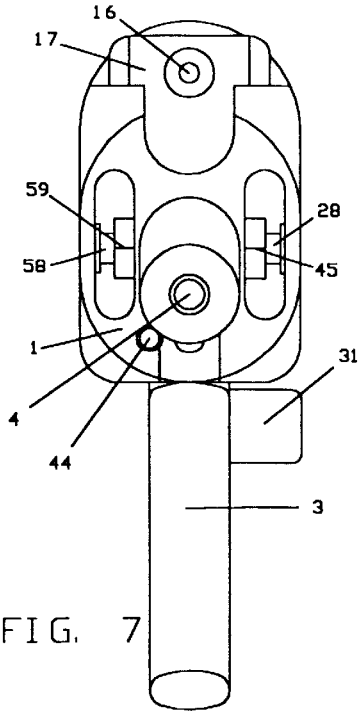
FIG. 7 is a rear view line drawing of the receiver fully assembled with components—rear stock removed, lightening slots are clearly shown as well as mounting screws and lock nuts which secure mainspring housing.

As best seen in FIG. 7, mounting is by a pair of screws 28, 58 which thread into the housing 4 and are secured by the locking nuts 45, 59. Access to the locking nuts is through lightening slots (either cast or machined) at the rear of the receiver 1. The cross sectional view in FIGS. 2 and 3 show the threaded location on the housing 4 and the end of screw 28.

FIG. 1 shows the action "ready to fire". The stored energy of the mainspring 26 rests indirectly upon the striker 10, transferred via the socket pin 25 and transfer pin 24. The striker is supported by the sear 12 and trigger 11. The striker 10 and trigger 11 both share a common pivot screw 14 which is ground and polished upon its major cylindrical diameter. It is threaded on one end which secures it into the breech block 2.

Figure 4:
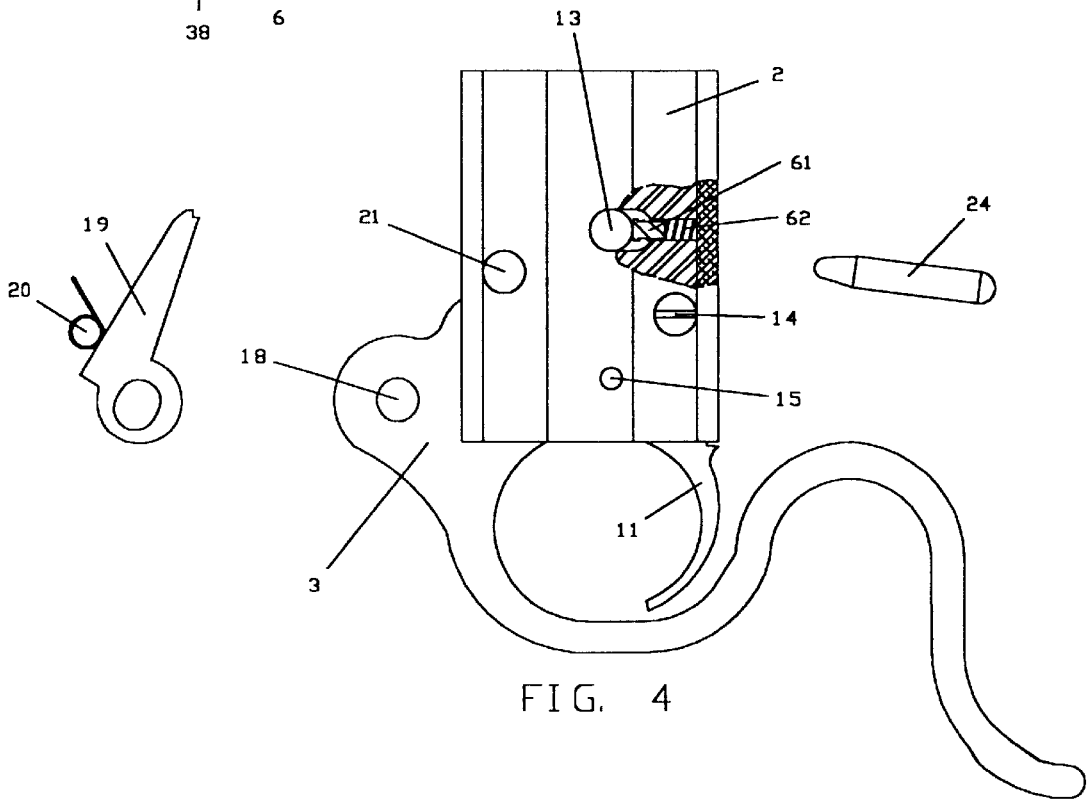
FIG. 4 is an exploded view showing the external views of all components which may be removed with the removal of the lever pivot, breech block attached to lever extractor with spring, and the transfer pin.

The safety lever 31 is in its forward "FIRE" position. The safety lever is blocked from view by the lever 3 in FIG. 1. The safety lever is shown in a different position, but more clearly visible in FIG. 2. This safety lever 31 pivots upon the pivot screw 32 and a pin affixed on the other end fits a slot in the safety 5. The safety is under spring pressure from the safety spring 29 and blocked from motion by the cocking pin 13. The cocking pin has a pair of small springs and guide pins to move it forward, shown respectively as 61 and 62 in FIG. 4.

With the safety on "FIRE", the action would be fired by pulling the trigger 11. This action would release the sear, allowing it to rotate upon its sear pivot pin 15. Once freed of the sear, the striker 10 moves rapidly forward. This motion propels the firing pin 9 forward into the primer and firing the chambered cartridge. The firing pin spring 8 is intended to provide a small amount of force to keep the firing pin 9 against the striker as the breech block is lowered to recock the action and reload.

Replacement of the firing pin bushing 7, firing pin spring 8, and the firing pin 9 with suitable alternative rimfire parts allow conversion from center-fire to .22 cartridges. Actions intended solely for .22 cartridges would use smaller diameter firing pin bushings to prevent ill advised conversion in the reverse.

The firing pin bushing 7 can be secured by a friction interference fit, setscrew, or cross pin. The use of the bushing simplifies the machining of the breech block 2, allowing the use of investment castings. This provides a solid metal barrier in the event of a ruptured cartridge case or primer. Alternately breech blocks may be manufactured from solid stock, but requires the addition of shield plate 17 and screw 16 as shown in drawings to offer similar protection. The shield plate 17 also acts as a cover for a pair of springs and pin bushings to keep the cocking pin 13 at its most forward positions.

The recommended method to return the safety to its "SAFE" position is to lower the muzzle and slowly lower the lever 3. If done with moderate restraint, the shell will return to the chamber and when the lever is again raised, the action will be loaded with the safety in the "SAFE" position.

FIG. 3 shows the cocking wedge 33 which is attached within the receiver by the screws 34 and 35. The symmetrically mounted wedge and screws which are their complement are not shown. These cocking wedges cause the cocking pin 13 and striker 10 to be cammed, simultaneously, towards the rear of the breech block 2. The safety 5 is spring driven by 29 upwards to block the cocking pin and striker. The same spring 29 pushes the sear return pin 30 which provides the sear 12 with a minimal return force.

During the breech block's downward travel, the lever 3 rotates with the extractor 19 remaining at rest as in FIG. 1. Near the final 10° of travel, a molded internal surface on the lever makes contact with a projecting step on the extractor 19. The slotted extractor is initially forced at an upwards angle, with spring pressure from the extractor spring 20 guiding the extractor into contact with the shell rim. The extractor, being cammed upwards by the lever creates considerable mechanical advantage. The tangential forces of contact with the case rim are redirected causing the cartridge to be moved rearward slightly and accomplishes primary extraction in a positive, but relatively effortless manner.

Figure 5:
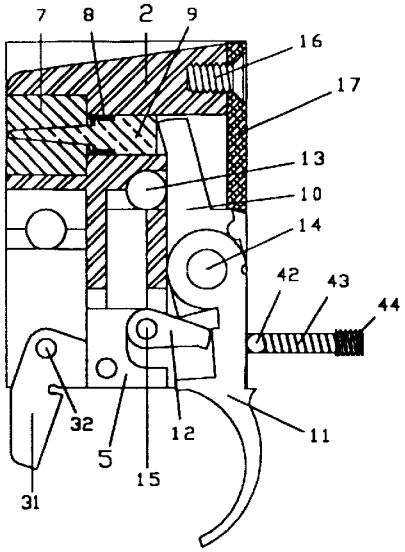
FIG. 5 is a cross sectional view showing the breech block internal components in their individual "fired" position, also to the rear of the breech block are shown the spring plunger components which contact the detent on the trigger, the striker, trigger, and safety are shown as true external views of the actual components.

Near the bottom of the breech block's travel (see FIG. 5), a spring 43 retained by setscrew 44 forces the ball 42 (see FIG. 5) into the detent at the rear of the trigger 11. This causes the trigger to be rotated slightly counterclockwise and the sear to come to rest underneath the lower left corner of the striker.

The extractor begins rotation when the extractor's slot makes contact with the lever pivot 18 (either screw or pin). The freed cartridge case is then fully removed by continued rotation of the lever. At the fully opened position, the extractor has continued in an arc such that is does not make contact with a fresh cartridge during reloading. The slot in the extractor will allow it to slip over the shell rim during a later stage of operation when the lever and action are again closed.

The action has been recocked and the safety lever will automatically be returned to its "SAFE" position.

FIG. 2 shows the action and components in the fully open position. The mainspring 26 and socket pin 25 are captive, at rest against the setscrew 27. There are no forces exerted upon the transfer pin 24 except that of potential energy due to gravity.

At this time with the bore inclined, (approximately 45° or greater), the action can be closed with the mainspring completely isolated from the hammer and firing mechanisms. This will hopefully avoid potentially hazardous conditions and accidents that occur when people try to release the mainspring tension by dry firing or other variations. Even in the unlikely case of a cartridge stuck in the chamber, this action is rendered safe. For a check, the lever will close and can be moved with minimal effort.

With the muzzle safely lowered below horizontal and pointed in a safe direction, a cartridge can be inserted into the chamber of the barrel. Once reloaded, the action would be closed by pulling the lever back and upwards.

During the upward motion of the breech block 2, the transfer pin 24 rests upon the receiver 1 and against the striker 10 until it slips into the (hemispherical, conical, etc.) depression on the back of the striker. At the same time the trigger (11) is moving upward, the ball (42) spring (43), and setscrew 44, which function as a ball plunger cause the trigger to rotate clockwise blocking the sear underneath the striker.

With further upwards movement of the breech block 2, this spring ball plunger provides a small forward force on the trigger 11. This holds the mechanism in position while the transfer pin 24 and mainspring 26 are engaged into the depression on the striker 10. After it has engaged, the transfer pin continues in an upward arc while its rearmost end pivots upon the socket pin 25 to compress the mainspring 26 until fully compressed as shown in FIG. 1.

FIG. 3 shows a cutaway view of the takedown latch assembly. It is attached to the forearm hanger 41 by a pin 40 located at its most rearward position nearest the receiver. The latch rotates upon this pin freely and a spring 37 places pressure to hold it against the adjustment screw 36. The adjustment screw is directly threaded into the forearm hanger.

The adjustment screw is turned outward by means of an Allen wrench. The wrench is passed through a bushed hole 38 through the stock and a narrow slot on the bottom side of the latch, into the head of the screw itself. The rounded head of the screw bears upon a matching concave surface on the inside of the takedown latch.

Figure 6:
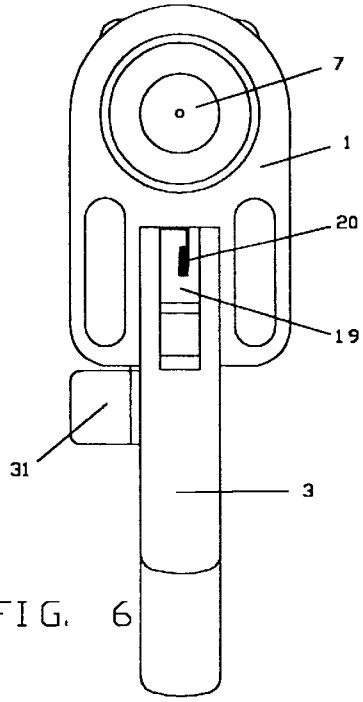
FIG. 6 is a front view, line drawing of the receiver fully assembled with components—barrel not installed, lightening slots are clearly visible with no attempt to show any hidden surfaces or components.

The rearmost projection of this latch is chambered to index itself into the slot provided at the front of the receiver (as shown in FIG. 6). The pin 39, longer than the slot width itself, is rotated in an arc until both ends rest upon each side of the slot. This places pressure between the barrel and receiver, adjusting for minor thread wear, and locks them into desired final position.

Figure 8:
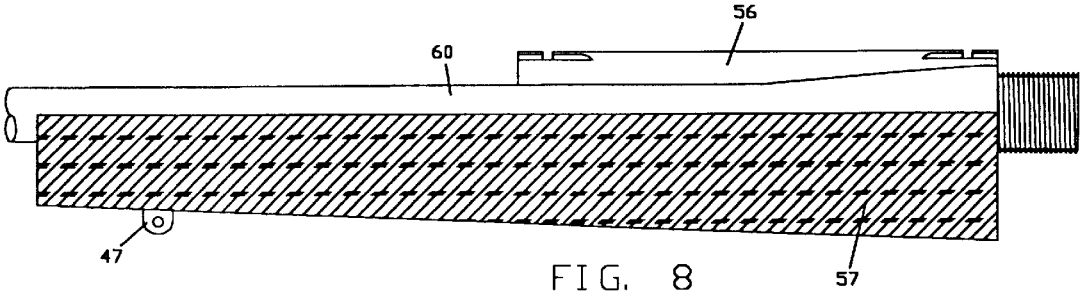
FIG. 8 is a left side view line drawing of the barrel assembly shown with external views of scope mounts and stock as removed from the rifle's action.
Figure 9:
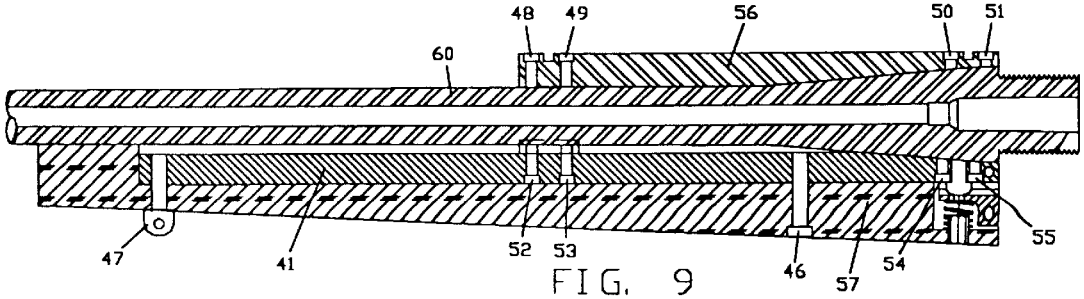
FIG. 9 is a cross sectional view of recommended mounting positions of scope mounts, mounting screws, forearm stock, and stock hanger, barrel is shown sectioned to improve clarity of view, takedown latch is shown as scaled to view.

FIG. 9 shows a cutaway view of FIG. 8, the barrel assembly as it would appear removed from the receiver 1. The stock hanger 41 is directly attached to the barrel by screws 52, 53, 54, and 55. These are mirrored symmetrically by the location of screws 48, 49, 50, and 51 which secure the scope base 56 to the barrel. The locating of the screws as such is intended to offset effects of uneven expansion or contraction upon the barrel. The mounting of the stock 57 is by two screws, the stock screw 46 and the front swivel screw 47.

The present invention provides an improvement in a falling breech block single shot action for a firearm where the mainspring and its housing are directly attached to the receiver. The rear of the mainspring housing is threaded for a stock screw. The striker and trigger are attached to the breech block. Connection is made by the transfer pin fitting into depressions on the hammer and socket pin of the mainspring. The striker and trigger use the same pivot screw. This significantly reduces misalignments caused by the combination of locating and manufacturing tolerances of each individual part. This allows precise manufacture of the rifle action without requiring excessive trigger over-travels or adjustment screws.

The present invention further provides an improvement in a falling breech block single shot action where the safety mechanism is automatic in operation and completely blocks the striker. This safety is so incorporated into the breech block requiring only three additional components to be added to the action.

In addition, the present invention provides an improvement in a falling breech block single shot action where the firing components and the mainspring are separable in a single operation. This is to relieve tensions on the mainspring and allows for increases in safety regarding storage.

Also, the extraction of fired cartridge cases is positive and operates in a smooth manner. The few required components are robust, rather uncomplicated, and do not project forward of the receiver.

The takedown and extractor only require the loosening of the latch mechanism and one screw to allow removal of the barrel and extractor for the purposes of storage, transport, or changing to different barrel assemblies/calibers.

The method of attachment of the forearm stock allows easy takedown, while limiting potential effects on accuracy and durability. The forearm hanger is mounted to the barrel directly opposite the scope mounting bases. This placement reduces the effects of barrel expansion upon accuracy while allowing a relatively free floated forearm with strong attachment locations for both stock and swivels.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A falling breech block rifle action, comprising:

a receiver having a vertical breech block chamber and a cartridge chamber;

a breech block slidably mounted in the breech block chamber;

a striker pivotally attached to the breech block by a first pivot pin;

a trigger pivotally attached to the breech block by the first pivot pin, the trigger being operatively linked to the striker and being movable from a first position restraining the striker form movement and a second position releasing the striker to fire a cartridge disposed in the cartridge chamber;

a mainspring housing directly attached to the receiver, and a mainspring disposed within the mainspring housing and operably linked to the striker; wherein, the mainspring housing includes a threaded attachment disposed to receive and secure a gun stock.

2. The falling breech block rifle action of claim 1 further including:

a lever pivotally attached to the receiver by a second pivot pin, and pivotally attached to the breech block by a connecting link of the lever being movable between a closed position and an open position;

an extractor attached to the receiver by the second pivot pin received in a slot formed in the extractor, the extractor including an elevated finger disposed to extend rearwardly and upwardly adjacent the cartridge chamber, the extractor being movable by contact of the lever such that the finger moves rearwardly and upwardly to contact the cartridge and extract it from the cartridge chamber when the lever is moved to the open position.

3. The falling breech block rifle action of claim 1 further including a safety mechanism pivotally attached to the breech block and being disposed to block movement of the striker when engaged.

4. The falling breech block rifle action of claim 2 further including a safety mechanism pivotally attached to the breech block and being disposed to block movement of the striker when engaged.

5. The falling breech block rifle action of claim 4 wherein the safety mechanism is automatically engaged when the lever is moved from the open position to the closed position.

* * * * *